US006237258B1

(12) United States Patent
Biro

(10) Patent No.: US 6,237,258 B1
(45) Date of Patent: May 29, 2001

(54) SNOW OR OTHER BULK MATERIAL REMOVAL APPARATUS

(76) Inventor: Stephen E. Biro, 3421 Helen Rd., Shaker Heights, OH (US) 44122

( * ) Notice: Subject to any disclaimer, the term of this patent is extended or adjusted under 35 U.S.C. 154(b) by 0 days.

(21) Appl. No.: 09/519,208

(22) Filed: Mar. 6, 2000

(51) Int. Cl.[7] ..... E01H 5/02
(52) U.S. Cl. ..... 37/285; 294/53.5
(58) Field of Search ..... 37/285, 265, 266, 37/268; 294/53.5, 54.5; 122/371; 16/110 R

(56) References Cited

U.S. PATENT DOCUMENTS

| | | | | |
|---|---|---|---|---|
| 1,034,992 | * | 8/1912 | Fulcher | 172/371 |
| 1,093,535 | * | 4/1914 | Civiita et al. | 172/371 |
| 1,570,180 | * | 1/1926 | Sturm | 172/371 |
| 2,098,609 | * | 11/1937 | Bishop | 306/13 |
| 2,239,297 | * | 4/1941 | Allen et al. | 294/51 |
| 2,699,614 | * | 1/1955 | Welch | 37/16 |
| 2,728,598 | * | 12/1955 | Szillage | 294/53.5 |
| 3,473,838 | * | 10/1969 | Rankin | 294/53.5 |
| 3,583,747 | * | 6/1971 | Lambert | 294/54 |
| 3,773,375 | * | 11/1973 | Nehls | 294/54 |
| 4,386,443 | * | 6/1983 | Kubick | 15/245 |
| 4,553,350 | * | 11/1985 | Hardy et al. | 47/1.5 |
| 4,597,204 | * | 7/1986 | Heiden | 37/285 |
| 4,888,942 | * | 12/1989 | Monaco | 56/400.01 |
| 4,947,562 | * | 8/1990 | Williamson | 37/197 |
| 4,970,853 | * | 11/1990 | Greene, III | 56/400.01 |
| 5,067,197 | * | 11/1991 | Cormier | 15/244.1 |
| 5,727,829 | * | 3/1998 | Bellichak | 294/51 |
| 5,791,707 | * | 8/1998 | Szakurski | 294/54.5 |
| 5,956,873 | * | 9/1999 | Hess | 37/265 |
| 5,971,653 | * | 10/1999 | Harpell | 403/97 |
| 6,086,049 | * | 7/2000 | Sheils | 254/131.5 |

* cited by examiner

*Primary Examiner*—Thomas B. Will
*Assistant Examiner*—Kristine Markovich
(74) *Attorney, Agent, or Firm*—Robert N. Lipcsik

(57) ABSTRACT

An apparatus (10) includes a planar engagement member (20), a plurality of support members (30, 40), and a cylindrical handle member (60). The engagement member (20) can move a bulk material across a substantially planar surface. The plurality of cylindrical support members (30, 40) is fixedly attached to the engagement member (20). The cylindrical handle member (60) is fixedly attached to the plurality of support members (30, 40). The handle member (60) transfers a force through the support members (30, 40) to the engagement member (20).

3 Claims, 1 Drawing Sheet

SNOW OR OTHER BULK MATERIAL REMOVAL APPARATUS

TECHNICAL FIELD

The present invention relates to an apparatus for moving bulk material across a surface, and more particularly, an apparatus for removing snow, mud, water, etc. from a planar surface.

BACKGROUND OF THE INVENTION

Plows for moving snow are known in the art. A conventional plow is constructed of metal or wood and is expensive to fabricate, easily splintered/broken, or too heavy to handle efficiently by a single person.

SUMMARY OF THE INVENTION

The present invention relates to a sturdy, simply constructed apparatus for moving bulk material across a surface rapidly and with little effort. The apparatus is constructed from materials easily obtained from home improvement or hardware stores. No tools other than a hacksaw, screwdriver, and drill are typically required for assembly of the apparatus. Thus, little labor and cost is expended to obtain the apparatus.

An operator of the apparatus grips a handle member and pushes or pulls the handle member along a surface. The handle member is fixedly connected to an engagement member. The engagement member pushes or pulls a bulk material across a surface thereby removing the bulk material from parts of the surface similar to an ice scraper used of the windshield of an automobile.

BRIEF DESCRIPTION OF THE DRAWINGS

The foregoing and other features of the invention will become more apparent to one skilled in the art upon consideration of the following description of the invention and the accompanying drawings, wherein.

DESCRIPTION OF THE PREFERRED EMBODIMENTS

Figures 1, 2:
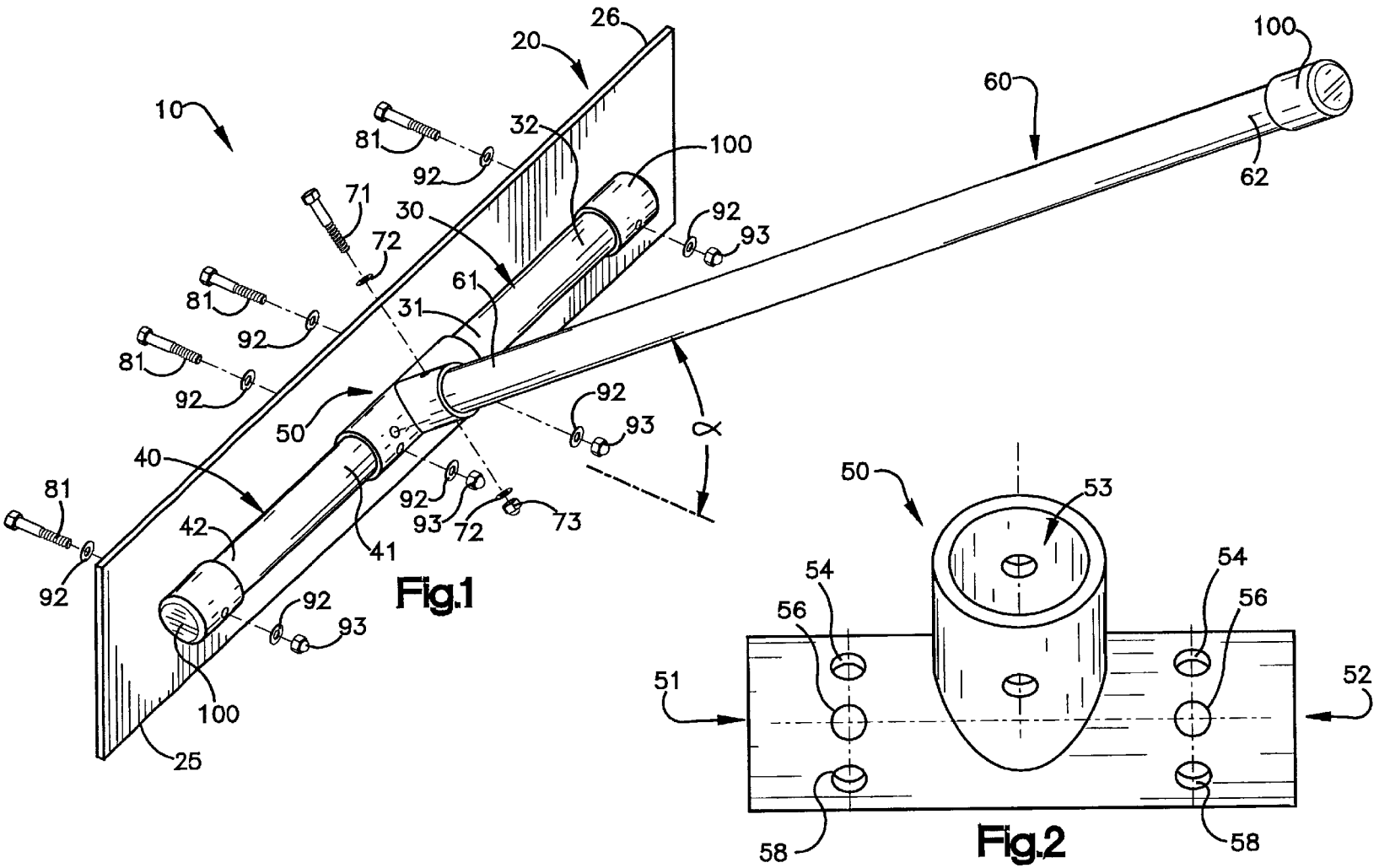
FIG. 1 is a schematic view of an apparatus embodying the present invention.
FIG. 2 is a detail view of part of the apparatus of FIG. 1.

According to the present invention, as illustrated in FIG. 1, an apparatus 10 comprises a planar engagement member 20, two cylindrical, tubular support members 30, 40, a one-piece, tubular connection member 50, and a cylindrical, tubular handle member 60.

The planar engagement member 20 can move a bulk material across a substantially planar horizontal surface. The cylindrical support members 30, 40 fixedly attach to the engagement member 20.

As illustrated in FIG. 2, the connection member 50 is a tee shaped structure with recesses 51, 52, 53 for receiving end portions 31, 41 of the support members 30, 40 and a first end portion 61 of the handle member 60. The first end portion 61 of the handle member 60 is fixedly attached to the connection member 50 by a PVC cement (not shown) in a manner known in the art. The first end portion 61 of the handle member 60 may be further secured to the connection member 50 by a fastener 71, two washers 72, and a retainer 73. The handle member 60 can thereby transfer a force through the support members 30, 40 and the connection member 50 to the engagement member 20.

The engagement member 20 is attached to the support members 30, 40 and the connection member 50 by a plurality of fasteners 81 penetrating the engagement member 20, the support members 30, 40, and the connection member 50. The engagement member 20, the support members 30, 40, and the connection member 50 have a plurality of holes for receiving the fasteners 81. A plurality of washers 92 and retainers 93 maintains the fasteners 81 within the holes, as illustrated in FIG. 1.

End caps 100 seal end portions 32, 42 of the support members 30, 40 and a second end portion 62 of the handle member 60 from dust, water, etc. The end caps 100 are secured to the support members 30, 40 and handle member 60 by a PVC cement (not shown) in a manner known in the art. As illustrated in FIG. 1, the end caps 100 at the end portions 32, 42 of the support members 30, 40 may also have holes for receiving the fasteners 81 and further strengthening the apparatus 10.

The connection member 50 may include a plurality of sets of holes 54, 56, 58 for adjusting an angle a of attachment between the engagement member 20 and the handle member 60. When a different angle of attachment is desired (i.e., for a taller/shorter user, to obtain greater leverage, etc.), the retainers 93 at the connection member 50 can be removed from the fasteners 81 and the fasteners 81 removed from the holes in the connection member 81. The connection member 50 may then be rotated while the end portions 31, 41 of the support members 30, 40 slide rotationally in the recesses 51, 52 of the connection member 50 so that one of the other sets of holes in the connection member 50 correspond to the holes in the engagement member 20. The fasteners 81 are replaced in the holes and the washers 92 and retainers 93 reattached to give the apparatus 10 a different angle $\alpha$ of attachment. With this feature, the PVC cement is not used to attach the support members 30, 40 to the connection member 50. The fasteners 81 and retainers 93 adequately maintain the structural integrity of the apparatus 10.

The entire apparatus 10 may be constructed of a polymer material to create a strong, lightweight, and corrosion resistant device. The engagement member 20 may be a ⅜ "thick polypropylene blade, about 38" long and 7" high. The bottom of the blade thus provides a low friction, non-gouging contact surface with the horizontal surface to be cleaned. The support members 30, 40 and handle member 60 may be constructed of 1½ "schedule 40 PVC pipe, about 14" and 56" long, respectively. The connection member 50 may be a 1½ "schedule 40 PVC tee.

The fasteners 71, 81 may be ¼ "×3"L Phillips head stainless steel bolts. The washers 72, 92 may be ¼ " stainless steel flat or lock washers. The retainers 73, 93 may be ¼" stainless steel lock nuts.

In operation, a person may walk behind the apparatus 10 gripping the handle member 60 thereby pushing the apparatus 10 and sliding the engagement member 20 across a substantially planar surface with the engagement member 20 substantially perpendicular to the surface. A person may also walk ahead of the apparatus 10 gripping the handle member 60 thereby pulling the apparatus 10 and sliding the engagement member 20 across a substantially planar surface with the engagement member 20 substantially perpendicular to the surface. The lower surface 25 of the engagement member 20 will thus create a seal which can push or pull a bulk material on the surface across that surface with very little bulk material remaining in the path of the already traveled apparatus 10.

An elastomer seal strip (not shown) may be attached to the lower surface 25 of the engagement member 20 to improve the integrity of the seal for small grain or liquid bulk materials. The seal strip may be natural rubber or other suitable elastomer and may be attached to the engagement member 20 by an adhesive or in any other manner known in the art.

The seal strip may also be placed on an upper surface 26 of the engagement member 20. The engagement member 20 may then be disconnected from the support members 30, 40 and the connection member 50, turned upside down, and reattached to allow optional use of the seal strip on the surface 26 when needed. The engagement member 20 may also be turned upside down and reattached if/when the lower surface 25 is damaged by wear, excessive loading, etc. thereby doubling the operational life of the apparatus 10.

From the above description of the invention, those skilled in the art will perceive improvements, changes, and modifications in materials, dimensions, color, etc. Such improvements, changes, and modifications within the normal skill of the art are intended to be included within the scope of the appended claims.

Having described the invention, the following is claimed:

1. An apparatus comprising:

an engagement member for moving a bulk material across a substantially planar horizontal surface, said engagement member having a first planar surface and a second planar surface opposite said first planar surface, said first planar surface engaging the bulk material;

a plurality of prefabricated, tubular, and cylindrical support members fixedly attached to said engagement member, said support members including corresponding end caps, said end caps of said support members being in direct contact with said second planar surface of said engagement member;

a prefabricated, tubular, and cylindrical handle member fixedly attached to said support members, said handle member transferring a force through said support members to said engagement member; and a prefabricated, tubular, cylindrical, and tee shaped connection member for attaching said support members to said handle member, said connection member being in direct contact with said second planar surface of said engagement member, said connection member and said support members each having a plurality of holes for receiving a corresponding plurality of bolts, each of said plurality of bolts being received by two of said plurality of holes, at least one of said plurality of bolts penetrating said connection member at two separate and distinct locations, at least one other of said plurality of bolts penetrating one of said support members at two separate and distinct locations, each of said plurality of bolts also penetrating each of said first and second surfaces of said engagement member in a direction perpendicular to both said first and second surfaces of said engagement member, each of said plurality of bolts engaging a corresponding plurality of nuts for securing said apparatus together.

2. An apparatus comprising:

an engagement member for moving a bulk material across a substantially planar horizontal surface, said engagement member having a first planar surface and a second planar surface opposite said first planar surface, said first planar surface engaging the bulk material;

a plurality of tubular and cylindrical support members fixedly attached to said engagement member;

a cylindrical handle member fixedly attached to said support members, said handle member transferring a force through said support members to said engagement member; and a tee shaped and tubular connection member for attaching said support members to said handle member, said connection member and said support members each having a plurality of holes for receiving a corresponding plurality of bolts, each of said plurality of bolts being received by two of said plurality of holes, at least one of said plurality of bolts penetrating said connection member at two separate and distinct locations, at least one other of said plurality of bolts penetrating one of said support members at two separate and distinct locations, each of said plurality of bolts also penetrating each of said first and second surfaces of said engagement member in a direction perpendicular to both said first and second surfaces of said engagement member, each of said plurality of bolts engaging a corresponding plurality of nuts for securing said apparatus together, said connection member having a curved outer surface for slidingly engaging said second planar surface of said engagement member as an angle between said engagement member and said handle member is adjusted.

3. An apparatus comprising:

an engagement member for moving a bulk material across a substantially planar horizontal surface, said engagement member having a first planar surface and a second planar surface opposite said first planar surface, said first planar surface engaging the bulk material;

a plurality of prefabricated, tubular, and cylindrical support members fixedly attached to said engagement member;

a prefabricated, tubular, and cylindrical handle member fixedly attached to said support members, said handle member transferring a force through said support members to said engagement member; and a prefabricated, tubular, cylindrical, and tee shaped connection member for attaching said support members to said handle member, said connection member and said support members each having a plurality of holes for receiving a corresponding plurality of bolts, each of said plurality of bolts being received by two of said plurality of holes, said connection member connecting said engagement member, said support members, and said handle member together, at least one of said plurality of bolts penetrating said connection member at two separate and distinct locations, at least one other of said plurality of bolts penetrating one of said support members at two separate and distinct locations, each of said plurality of bolts also penetrating each of said first and second surfaces of said engagement member in a direction perpendicular to both said first and second surfaces of said engagement member, each of said plurality of bolts engaging a corresponding plurality of nuts for securing said apparatus together.

* * * * *